United States Patent [19]

MacKay

[11] Patent Number: 4,792,975

[45] Date of Patent: Dec. 20, 1988

[54] DIGITAL SPEECH SIGNAL PROCESSING FOR PITCH CHANGE WITH JUMP CONTROL IN ACCORDANCE WITH PITCH PERIOD

[75] Inventor: Kent W. MacKay, San Bruno, Calif.

[73] Assignee: The Variable Speech Control ("VSC"), Santa Clara, Calif.

[21] Appl. No.: 23,905

[22] Filed: Mar. 10, 1987

Related U.S. Application Data

[63] Continuation of Ser. No. 500,633, Jun. 3, 1983, abandoned.

[51] Int. Cl.[4] ..... G10L 1/00

[52] U.S. Cl. ..... 381/34

[58] Field of Search ..... 364/200, 900, 513.5, 364/513; 381/29, 30, 31, 32, 33, 34, 35, 36, 38, 39, 40, 41, 42, 53, 54

[56] References Cited

U.S. PATENT DOCUMENTS

| | | | |
|---|---|---|---|
| 3,104,284 | 9/1963 | French et al. | 381/34 |
| 3,816,664 | 6/1974 | Koch | 381/32 |
| 3,949,174 | 4/1976 | Sutton | 381/35 |
| 3,949,175 | 4/1976 | Tanizoe et al. | 381/34 |
| 4,020,291 | 4/1977 | Kitamura et al. | 381/35 |
| 4,121,058 | 10/1978 | Jusko et al. | 381/32 |
| 4,228,322 | 10/1980 | Bringol et al. | 381/34 |
| 4,415,772 | 11/1983 | Eppler et al. | 360/8 |
| 4,464,784 | 8/1984 | Agnello | 381/34 |

OTHER PUBLICATIONS

Bennett, Ian, "A Study of Speech Compression Using Analog Time Domain Sampling Techniques", Stanford University Doctoral Dissertation, May 1975, (Chapters IV, V, VI).

Neuborg, Edward, "Simple Pitch-Dependent Algorithm for High Quality Speech Rate Changing", Journal Accoustical Society of America, 62(2), Feb. 1978.

Francis F. Lee, "Time Compression and Expansion of Speech by the Sampling Method", Journal of the Audio Engineering Society, Nov. 1972.

*Primary Examiner*—Gareth D. Shaw
*Assistant Examiner*—John G. Mills, III
*Attorney, Agent, or Firm*—Charles E. Pfund

[57] ABSTRACT

Digital processing of speech signals for compression-/expansion pitch change is provided by writing and reading a ROM at different rates and controlling the discard/repeat segments of memory to be approximately integral multiples of the pitch period with means to track the pitch period as it is changing and modify the discard/repeat segments accordingly.

8 Claims, 4 Drawing Sheets

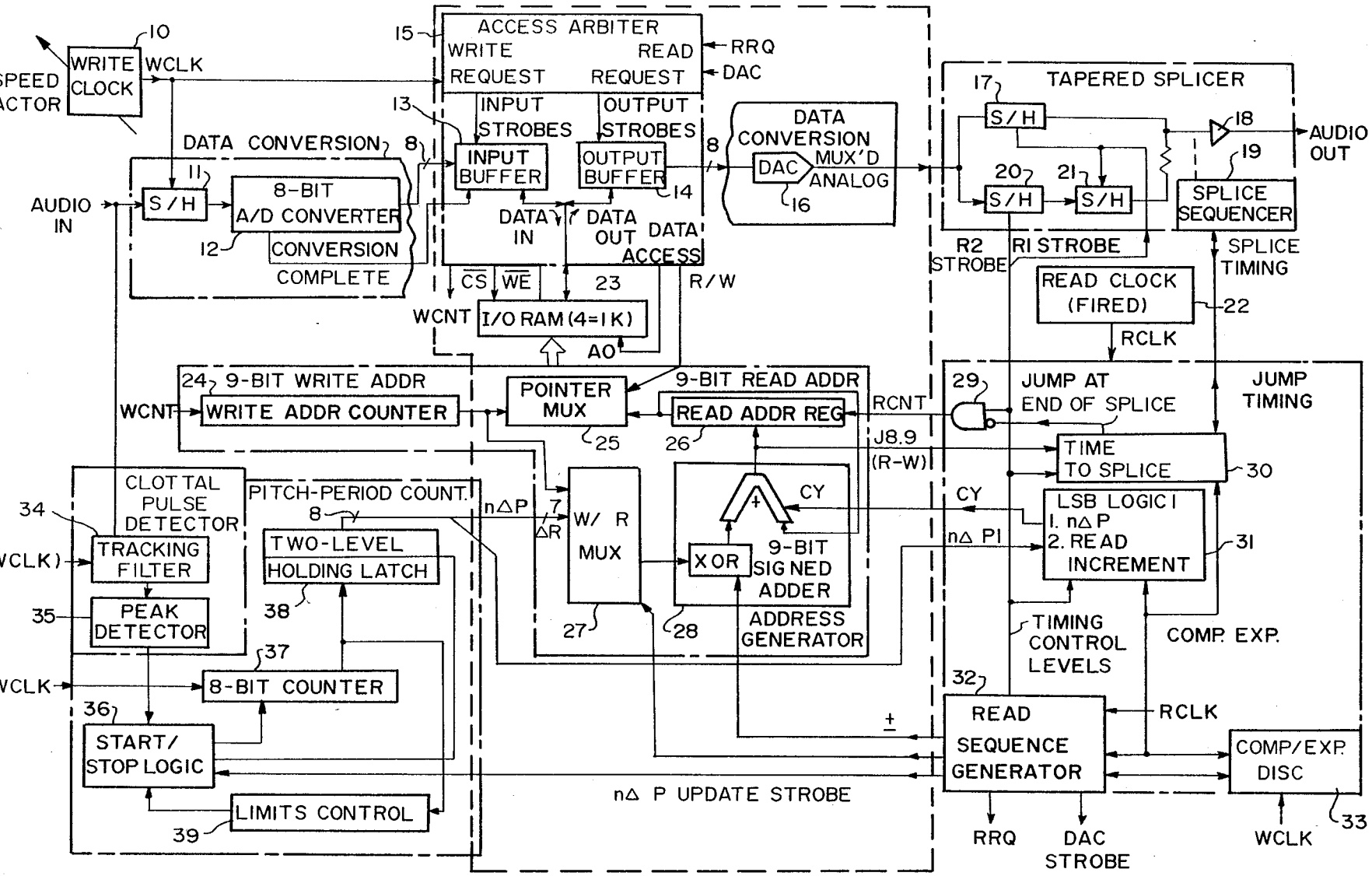
FIG. IC
FIG. IB
FIG. IA

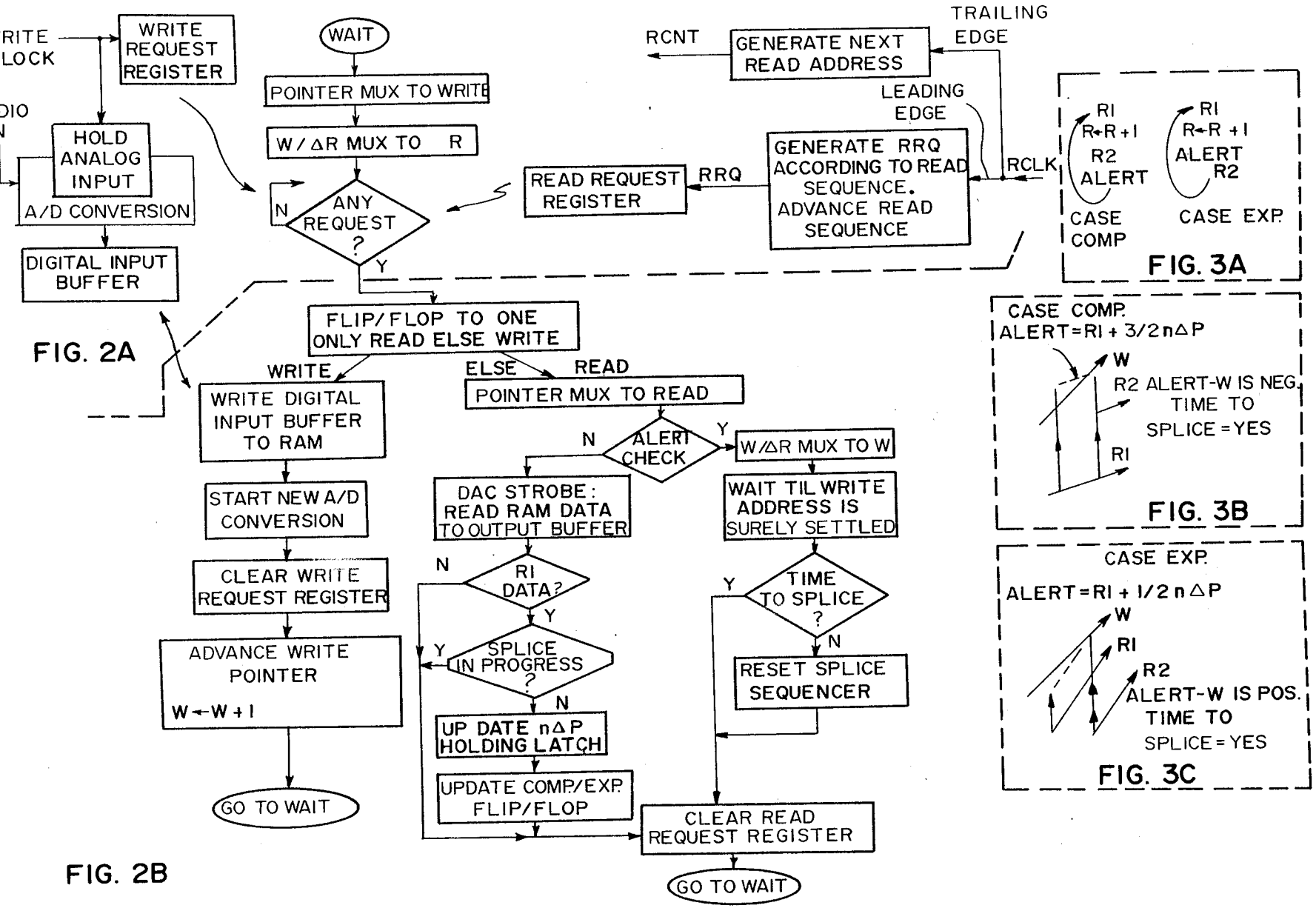
WAIT
POINTER MUX TO WRITE
W/ΔR MUX TO R
ANY REQUEST ?
N
Y
WRITE REQUEST REGISTER
HOLD ANALOG INPUT
A/D CONVERSION
DIGITAL INPUT BUFFER
WRITE LOCK
RCNT
GENERATE NEXT READ ADDRESS
TRAILING EDGE
LEADING EDGE
RCLK
GENERATE RRQ ACCORDING TO READ SEQUENCE. ADVANCE READ SEQUENCE
RRQ
READ REQUEST REGISTER
FLIP/FLOP TO ONE ONLY READ ELSE WRITE
WRITE
ELSE
READ
POINTER MUX TO READ
ALERT CHECK
W/ΔR MUX TO W
WAIT TIL WRITE ADDRESS IS SURELY SETTLED
TIME TO SPLICE ?
RESET SPLICE SEQUENCER
CLEAR READ REQUEST REGISTER
GO TO WAIT
DAC STROBE: READ RAM DATA TO OUTPUT BUFFER
RI DATA?
SPLICE IN PROGRESS ?
UP DATE nΔP HOLDING LATCH
UPDATE COMP/EXP. FLIP/FLOP
WRITE DIGITAL INPUT BUFFER TO RAM
START NEW A/D CONVERSION
CLEAR WRITE REQUEST REGISTER
ADVANCE WRITE POINTER
W←W+1
GO TO WAIT
FIG. 2A
FIG. 2B
CASE COMP.
RI
R←R+1
R2
ALERT
CASE EXP.
RI
R←R+1
ALERT
R2
FIG. 3A
CASE COMP.
ALERT=RI+3/2nΔP
W
R2 ALERT-W IS NEG.
TIME TO SPLICE=YES
RI
FIG. 3B
CASE EXP.
ALERT=RI+1/2nΔP
W
RI
R2
ALERT-W IS POS.
TIME TO SPLICE=YES
FIG. 3C

DIGITAL SPEECH SIGNAL PROCESSING FOR PITCH CHANGE WITH JUMP CONTROL IN ACCORDANCE WITH PITCH PERIOD

This is a continuation of co-pending application Ser. No. 500,633 filed on June 3, 1983, now abandoned.

This invention relates to speech signal processing and more particularly to reproducing speech signals with pitch change, accomplished by digital write and read techniques and incorporating a jump control based on the signal pitch period.

BACKGROUND OF THE INVENTION

The usefulness of an economical system for real time pitch changing of an audio signal or for speech compression and/or expansion (that is, pitch restoration of the audio signal generated by speeded or slowed playback of a recording) is well recognized today. The early forms of such systems were electromechanical tape players with moving magnetic read heads. These systems produced the equivalent of cutting the record tape into short segments and splicing alternate segments together. These early schemes have been replaced by all-electronic systems such as those described in Schiffman patents U.S. Pat. No. 3,786,195 and U.S. Pat. No. 3,936,610 which have been widely used commercially.

The Schiffman approach and most other practical systems rely on a pitch change-splice approach. That is, in the case of audio pitch lowering, regular segments of the signal are stretched to achieve pitch change and the intervening remainders are deleted resulting in discontinuities created by the deletion. In the case of audio pitch raising, the repetitive pitch change is accomplished by compressing the time interval occupied by the signal segments thus creating gaps; the compressed segments are then repeated as necessary to fill the gaps created by the compressing of the signal.

Continual work has been done on improving the sound quality of the "pitch change-splice" methods, mostly centered on improving the splicing scheme. The suggested approaches usually involved a rather microscropic analysis of the waveform at splice points, the splice points having generally been predetermined by system constraints regardless of the instantaneous or general characteristics of the waveform being processed. That is, focus has been on the instantaneous values of waveform parameters (such as level, slope, and/or direction i.e. polarity of slope) and on matching, in respect to one or more of those values, the trailing edge of the segment to be terminated with the leading edge of the segment to be next connected. Zero crossing splicing (with and without coincidence of polarity), level matching, overlap schemes and others have been tried, but the improvement in sound quality generally was less than expected.

One example of a digital zero energy level matching scheme is found in the patent to Lee U.S. Pat. No. 3,803,363, where audio signals were converted into digital format and stored in random access memory and read out at a different rate than that at which they were written in memory. When the addresses at which memory access for write and read are taking place came close to converging (which occurred because the write and read rates were different), jumping to a new address which was selected to have a low energy level or "zero crossing."

Another digital scheme which provided for writing and read at different rates in the digital memory conditioned the jump so that, when the addresses converged on examining the signals in storage, the jump is delayed until a suitable match between the waveforms was located. This system as described in the patent to Jusko et al., U.S. Pat. No. 4,121,058, provided additional features such as looping for review of specific portions of the message and interrupting the input storage in order to hold the segment under review in memory.

In each of the foregoing digital schemes of Lee and Jusko et al., the jump of the read pointer to its new address in memory is preselected to utilize substantially all of the memory capacity such that the initial differential between the write and read pointers is constant except for the small variation occasioned by the microscopic examination and adjustment made to provide a signal level match.

Research such as that done by Ian Bennet (May, 1975, Stanford University Doctoral Dissertation in Dept. of Electrical Engineering, *A Study of Speech Compression Using Analog Time Domain Sampling Techniques*) has shown that in the case where the audio signal is speech, if the signal segments which are stretched or compressed by the processing circuit are synchronous with the pitch periods of the fundamental voiced frequency, there is significant improvement in the sound quality of the processed audio. (Note that if the fundamental voice frequency is extracted and examined, then the pitch period is simply the period of that fundamental.) The complete (unfiltered) speech waveform, however, is not a pure sinusoid, even for voiced sounds, but rather a repetitive pattern each period of which generally begins with a glottal pulse followed by a damped waveform over the remainder of the epoch. Some schemes for pitch synchronous processing have been described, but they generally became quite elaborate and complicated because they require detection of the beginning of epochs (i.e. the glottal pulse) and processing by discarding or repeating one or more integral epochs.

Neuberg (Neuburg, Edward P., "Simple pitch-dependent algorithm for high-quality speech rate changing", *J. Accoust. Soc. Am.*, 63 (2), February 1978) has suggested a new version of the original cut and splice method. Neuberg has proposed that for pitch lowering, the deletion (or in the case of pitch-raising, the repetition) of segments equal in length to an epoch, but regardless of where they started or ended, would produce good results.

This was explained in terms of speech characteristics where, for many voiced sounds, successive epochs contain a repetition of almost identical waveforms of the same pitch period which may continue for many such pitch periods. Thus, deletion of any segment equal in length to the pitch period maintains the cadence of the pitch periods. This approach was stated as leading to a major improvement, which could not result from splicing techniques which focus solely on "microscopic" matching of waveform parameters, and could in theory at least be accomplished more readily and simply than true pitch synchronous systems. Moreover, this approach automatically results in a fair degree of wave matching in the "microscopic" sense, since to the extent that the pitch period and waveform do not change from epoch to epoch, the end of the one segment and the beginning of another (with one or two pitch periods deleted in between) will often match closely in regard to level, slope, etc.

SUMMARY OF THE INVENTION

The present invention provides for digital pitch change with the jump in memory location for the read signal determined by the pitch period. By tethering the separation of the read address from the write address so that it repetitively returns to a separation of one half nΔP, the distribution of error of the jump amount with respect to the ideal jump amount (which is n actual pitch periods of the jumped signal) is uniformly distributed with respect to a zero error condition. The overall result is that improved pitch changed reproduction is achieved.

This application is related to applicant's joint invention entitled Method And Apparatus—Pitch Period Controlled Voice Signal Processing, Ser. No. 500,632 Filed June 3, 1983, now abandoned and refiled as continuation application, Ser. No. 935,604, filed Dec. 1, 1986 the disclosure of which is hereby incorporated by reference.

DESCRIPTION OF THE DRAWINGS

FIGS. 1A, 1B and 1C are a block diagram of the system in accordance with the invention.

FIGS. 2A and 2B are a flow chart showing sequence programming for the system of FIG. 1.

FIGS. 3A, 3B and 3C are diagrams useful in explaining features of the operation of the invention.

DESCRIPTION OF THE PREFERRED EMBODIMENT

Figure 4:
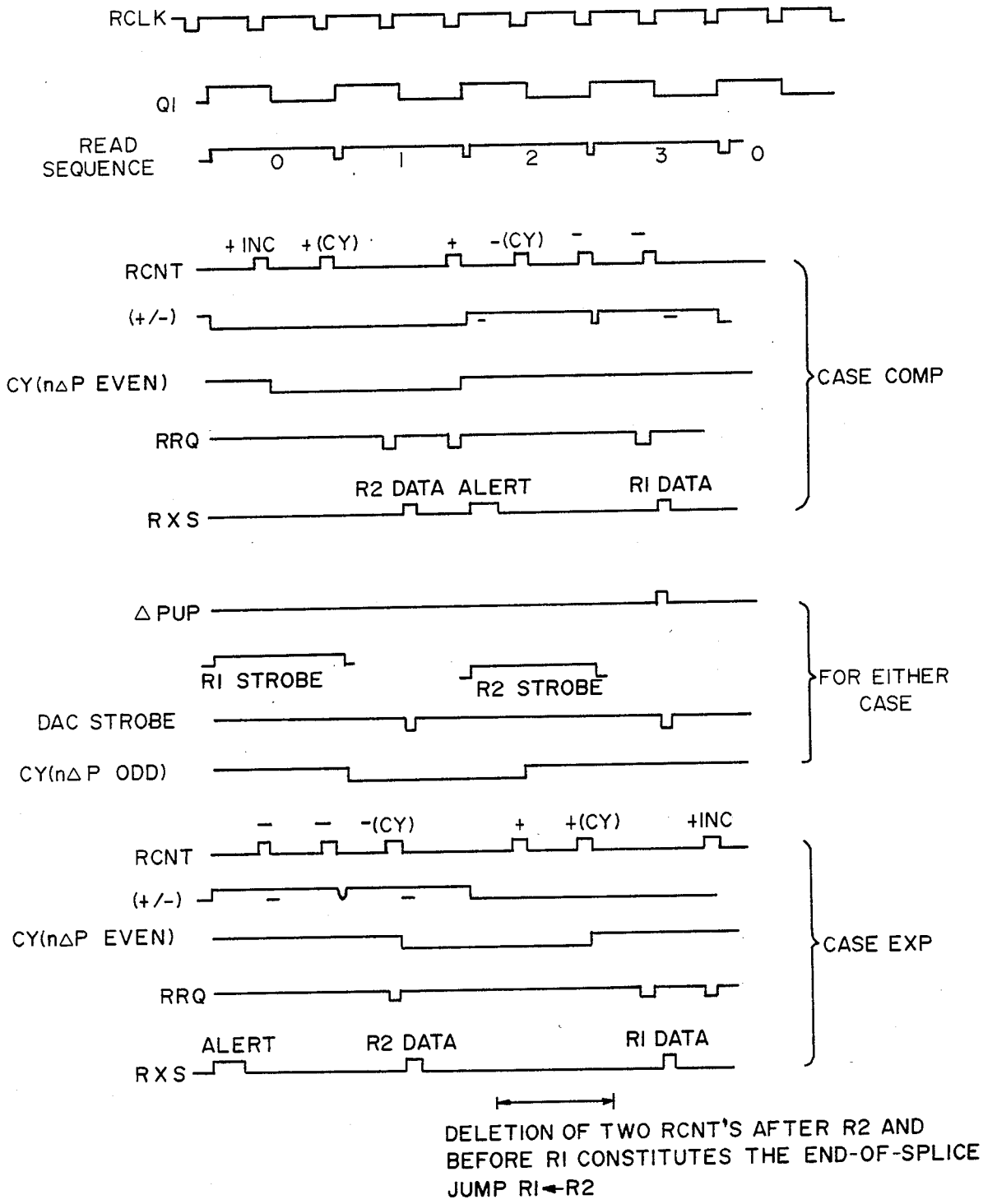
FIG. 4 is a timing diagram for certain operations of the disclosed system.

Referring now to FIGS. 1A, 1B and 1C assembled as indicated the present preferred embodiment will be described. The general functions of DATA CONVERSION, PITCH PERIOD COUNTER, DATA ACCESS, ADDRESS GENERATOR, JUMP TIMING are present and in addition there is a TAPERED SPLICER. DATA ACCESS includes an access arbiter 15, which performs a function similar to that of the ACCESS CONTROL PROCESSOR in the referenced application, that is, access arbiter 15 determines the timing of when to read and when to write. A variable frequency write clock 10 tracks the tape speed or other pitch-change command by means of a control signal herein called "speed factor which depends on the tape speed or other pitch change command." The write clock 10 controls the timing of a sample-and-hold circuit 11, the audio input being sampled and the sampled value being held so that the A/D converter 12 can operate on a stable level during its conversion time. When the 8-bit A/D conversion is complete a "conversion complete" signal strobes that data into the input buffer 13. The audio analog input is thereby converted to digital data for placement in the input buffer 13. When write clock 10 starts the sample and hold process it also generates a write request to ACCESS ARBITER 15. If the ACCESS ARBITER 15 is not busy handling a read operation, the write request is acknowledged immediately and the write process then strobes the data from input buffer 13 into the RAM 23. DATA ACCESS logic handles the timing, issuing a signal chip select ($\overline{CS}$) signal to enable the RAM, and it issues a write enable ($\overline{WE}$) signal to indicate to the RAM that it is a write operation that is being performed. It also issues a signal called "A Zero" (AO), which is the least significant bit of the address used to load four bits into one address location and the second four bits into an adjacent location of the RAM. The bar over these designators in the figures simply indicates that the RAM hardware is implemented with negative logic.

The addresses for the RAM are generated in the ADDRESS GENERATOR. A simple address counter, a 9-bit counter 24, is driven by a signal called W count, "WCNT," which is the last signal generated in a write access process. The ADDRESS GENERATOR logic insures that there is a maximum amount of time for the write address to settle before the next write clock pulse occurs. The write address counter 24 supplies one input of the pointer MUX 25 so that the address lines to the RAM are shared between the read address, coming from read address register 26, and the write address coming from counter 24. The read address register 26 acts as a holding latch to hold the read address. In order to increment the read address, the jump logic in a 9-bit signed adder 28 is used to produce an increment in the read address latch register 26, as explained in the timing diagram FIG. 4. The read address latch 26 produces a 9-bit word. It is always feeding one input of the 9-bit signed adder 28. The other input is supplied with either a number from the nΔP, or with a number from the write address counter 24 via a W/ΔP MUX27. The read address is incremented by just one count by using the "carry" or "CY" input to the signed adder. If the system is operating in the compression mode requiring a jump forward, the nΔP jump also uses a carry which produces nΔP+1 from the carry, and then it jumps back, subtracting nΔP, and in that case the carry is not used so that the net result is to have one count added to the read address.

The ACCESS ARBITER 15, when it receives a read request (RRQ), performs a read cycle. The read request RRQ is derived from the read clock 22 by way of the jump timing block. The read clock 22 is running at a higher rate than ordinarily used in order to do several different operations in the read cycles to provide for two read pointers with outputs of two different data segments. There are two reads available for each read that is actually an output. There is a signal called DAC STROBE-ENABLE supplied to arbiter 15 that strobes the output buffer so as to obtain a new data word from the RAM and hold it in an output buffer 14 so that the DAC 16 can receive a new word which it converts to an analog signal.

The DAC strobe enable signal is common to two different operations. One operation is called R1, read one, which is the primary read channel output. The strobe is also common to R2, which is a secondary read channel. Both R1 and R2 are used in the tapered splicer logic. The R2 strobe and R1 strobe are received from JUMP TIMING, logic in alternate sequences. The read R1 strobe is strobing sample-and-hold 17 to pick up the read data from DAC 16 at the proper time when that DAC is providing R1 data which is being held in output buffer 14. On alternate read cycles, a similar operation occurs with R2 strobe which strobes sample and hold circuit 20. At that particular time a different address generated through the ADDRESS GENERATOR exists so that the output buffer 14 now holds data that is coming from a different location in memory, i.e. that location designated R2, for the secondary read channel. There is an additional sample-and-hold 21, that reconciles the two times that are necessarily different for R2 strobe and R1 strobe, so that the analog data that are combined in the common output load of sample-and-hold 21 and sample-and-hold 17 occur at one time, both changing exactly on the R1 strobe. To do this, the R2 signal is delayed by an additional half cycle because of sample and hold 21. A splice sequencer 19 in effect can be conceptually visualized as controlling a potentiometer between 21 and 17, so that the jump is not a single large step operation, but is actually a number of smaller steps where the splice sequencer 19 can be visualized to be moving down the tap on that potentiometer so that the output signal slowly moves from the R1 channel side of S/H 17 to the R2 channel side of S/H 21. At the end of the time it takes for the tap to so move a gradual change of the AUDIO OUT signal (i.e. referred to as a tapered splice) has occurred and the logic must be then reset. To do this, the tap of the potentiometer can be visualized as moving back up to the R1 channel side where it first started.

A summing amplifier 18 is provided to perform the analog operation of summing the two channels. The splice sequencer 19 is a simple counter that controls the summing weight (visualized as the position of the top) of the signal feeding amplifier 18.

The read clock 22 has a fixed rate established by the sampling rate, and is actually driven at a frequency eight times higher than is necessary for the single channel read output because the jump timing block uses it to divide down to do the different sequences, i.e. to handle the two channels R2 and R1 and also to handle the alert timing to test whether the two pointers (R and W) are nearing collison so as to perform the tapered splice and jump operations. The jump timing logic includes LSB (least significant bit) logic 31 which performs two functions. The first function is to provide for handling the two possible types of nΔP jumps, i.e. when nΔP is an odd number or an even number. Because in this scheme the actual jump is one-half of that nΔP number, the process is repeated twice in order to extract one nΔP interval. If nΔP happens to be odd, an odd result is created by jumping half nΔP without using the carry and then jumping by another half nΔP with carry asserted so as to achieve an odd result. When nΔP is even the least significant bit can be ignored.

The second function of LSB logic 31 is to exploit that same carry signal to cause the read address latch 26 to increment from one cycle to the next. In the above referenced patent application the basic architecture did not need to know explicitly whether the system was running in expansion or compression; the actual collapse of the pointers and the direction in which they were collapsing were used to tell when to jump whether in compression or expansion. In the system depicted here, a compression/expansion discriminator 33 operates, with inputs of the write clock and a sub-multiple of the read clock divided down so that at a compression ratio of one the write clock and the sub-multiple of R clock are at the same frequency. If one is higher than the other, then compression/expansion discriminator 33 will issue a single logic signal that indicates either a compression or an expansion mode so that the jump timing logic can take that into consideration.

The read sequence generator 32 controls the various actions that have to be performed during the read time, and it is driven by R clock (RCLK), so it looks ahead when R clock changes state, e.g. when the rising edge of R clock occurs, for instance, then the read sequence state generator 32 will sequence to its next sequence. Then the R clock generates at the same time the read request signal RRQ that is supplied to the access arbiter 15. By the time the read request has been acknowledged by the access arbiter 15, the operation of the read sequence generator has settled and it delivers timely control levels that are stabilized at the time that the read request operation needs to use them.

The jump in this system is somewhat different from that in the referenced patent application. Instead of performing a discrete jump after measurement, this system performs test jumps all the time to test pointer positions. To implement a jump, inhibit signals are used so that an R1 read and an R2 read occur with R2 as a new address when a jump is to be made. This is done with inhibit gate 29, which inhibits the pulses that would normally return the read address from R2 to R1, so that it stays in that new location. The time to do that is determined by "time to splice" logic 30 which monitors bits J8 and J9, which are the most significant bits out of the 9-bit signed adder. These signals are combined with the compression/expansion signal from discriminator 33 to tell whether or not the differences between read address and write address is a small positive number or a small negative number, depending on the case of compression or expansion, respectively.

The read address register 26 is now simply a latch rather than a complex presettable counter, as in the referenced patent application, and only seven bits are wired into the W/ΔP multiplexer 27 rather than the eight that were used in the other design. The reason for using only seven bits is that in this system the jump is only by one half nΔP and it is done twice in order to produce a whole nΔP. The least significant bit out of the pitch period counter is called nΔP1. It is sent to the jump logic LSB 31 to appear as a carry during certain times in order to produce the odd nΔP additions or subtractions as the case may be.

The pitch period function is divided into two parts in FIG. 1A. A glottal pitch detector, or pitch extractor is an analog device which includes a tracking filter 34 that filters the high end of the audio spectrum in the following way. If the tape speed is faster it has a wider bandpass because the audio coming from the tape head will be shifted up in pitch, and it is desired not to filter out those higher frequencies that really are relevant, since they will be part of the normal speech spectrum after pitch restoration. The tracking filter tracks a function of the write clock f(WCLK) in order to produce a normalized spectrum from which a peak detector 35 produces logic pulses. These pulses are a logic signal to start/stop logic 36 which cause a counter clock 37 to stop and reset to zero, but before that happens the value that was at the counter 37 output is loaded into a two level holding latch 38. A two level holding latch is used here because of the splicing operation. The value of nΔP cannot change during the time of splicing. If that were allowed to happen there would be a discontinuity in the splice. If splicing occurs at the same time that the pitch period circuit detects a glottal pulse the system stops the bit counter 37, and starts it up again, without losing that number, so it is loaded into the earlier level of the holding latch 38. It is not loaded to the output level of the holding latch 38 until after the splice is finished; after that the available number is transfered into the output side of the latch.

Timing is handled by the read sequence generator 32 because it is during the read sequence time that the system does the tapered splicing.

Read sequence generator 32 also supplies $n \neq P$ update strobes to the PITCH PERIOD COUNTER. There are three strobes, one for the start/stop logic, and two for the holding latch.

The jump timing in this invention is functionally the same as the jump control disclosed in the referenced application. The jump control of that application has been split into two parts, an address generator and a jump timing block that performs the complex problem of doing jump control. The architecture in the address generator, which embodies the 9-bit signed adder, is then common to both applications, and what is different here is what is shown in JUMP TIMING. This can be considered as a microcode that programs the address generator.

Referring now to the flow chart FIGS. 2A and 2B the programming appears simpler than the flow chart for the referenced application only because timing for the flow chart is given in the jump timing waveforms of FIG. 4. The analog to digital converter uses sample-and-hold logic. The write clock samples the audio input to hold the analog value before it starts converting. Then that same write clock signals the data access block at the decision diamond on the flow chart called ANY REQUEST? This is a waiting loop where the data access module is waiting for a new write clock that is held in the write request register. The write request register and read requester register are the same thing as the tick registers in the referenced application. So when the analog signal is held, it also requests the write cycle and when the write cycle occurs an analog to digital conversion is performed. However, this conversion makes the digital data available for the next cycle, because the current data was converted in the previous cycle and is now resident in the digital input buffer, so in the write cycle the data from the digital input buffer is written into the RAM. Then a new conversion is started, which clears the write request register. Finally, as the last operation during the write cycle, the write counter is incremented from W to W+1, and the program returns to wait.

For a read request, RRQ, the program will be waiting in the "ANY REQUEST?" loop. When waiting in this loop the pointer MUX 25 is always put into the write mode and the W/ΔP MUX into the ΔP mode, so for the read process, the first step must be to put the pointer MUX into the correct mode. Since the pointer MUX will always be in the write mode initially, to start the read cycle (i.e. after a flip-flop to the case of a read cycle) the first order of business is to place the pointer MUX in the read mode position.

The read process can do two kinds of jobs. One job is to check the fact that the write and read pointers are converging toward one another, which condition is called the alert, and the other job is actually to read the data out of the RAM. If an alert check gives the answer no, a signal strobes the DAC to read the RAM data to the output buffer. It it is time for R1 data and no tapered splicing operation is in progress then other tasks are performed. One of these is to update the nΔP holding latch, and the other one is to decide whether or not the system is in compression or expansion. Now if these checks are made in the primary (R1) cycle, stability is improved. The job of finding out whether the system is in compression or expansion is facilitated and can even handle cases where the write clock is jittering. A write clock that is increasing in frequency and then decreasing in frequency rather rapidly, centered around the read clock frequency, produces a continual switching back and forth between the compression and expansion modes. If the compression/expansion indicator is allowed only to toggle at this particular time in the flow chart, then the system can easily handle the case of a jittering clock without causing the logic to operate incorrectly.

As the last order of business common to anything in the read process the read request register (the tick register) is cleared so that the process is not repeated.

In the read process, if it is not time to do a read of either the R1 data or the R2 data, then the system performs an alert check. In that case the address generator with the 9-bit signed adder is used in a manner to allow for comparing the current address in the read address latch register 26 with the current write address. So the W/ΔP MUX is put to the W position. Then the W/ΔP MUX 27 will select write address information from counter 24 to be delivered to the exclusive OR 28, and the exclusive OR inverts that data so that the 9-bit adder can be used as a subtractor, because the W data is negated by exclusive OR 28. This allows a comparison and gives the R-W result. Now because comparing the write counter may occur when the write process may have just happened, it is possible that the write address counter is still settling, so a delay is introduced here to make sure that the write address is settled, and then the most significant bits of the result of the 9-bit signed adder, called J8-J9 are tested to determine whether it is time to splice. Time to splice is determined in the jump timing module 30 in FIG. 2B called TIME TO SPLICE? If it's not time to splice, then a reset pulse is delivered from module 30 to the splice sequence generator 19. That pulse holds the splice sequencer always in the reset condition so that the amplifier 18 is always monitoring R1 data.

When it is time to splice, the splice sequencer is allowed to sequence up. This sequencing continues over several cycles so that the splice sequencer will move the arm of the potentiometer 19A slowly down to secondary channel R2. When that operation is finished, the splice sequencer 19 sends a signal on the line called "splice timing" back down to Time To Splice module 30 which causes an inhibitory signal to be applied to inhibiting gate 29 to delete two counts, which otherwise would have caused the R count to return from R2 to R1. Because of this, R1 does become R2.

As shown more explicitly in the timing diagram FIG. 4, the timing is determined by the read clock RCLK running at a high rate and counting out four cycles, in a sequential counter that produces READ SEQUENCE as explicit levels, 0, 1, 2, 3, then repeats 0, 1, 2, 3. Actually the read clock counts eight, but is divided down to a lesser number of cycles. A signal called Q1 which is half the rate of the read clock drives the address generator to produce the read address latch execution strobe, a signal called RCNT. There are different kinds of jobs that the address generaor must perform. The legends at the top of the RCNT waveform of FIG. 4 indicate what kind of job is being performed. When the indicator shows "plus increment", +INC, it means that one half nΔP is added to the current value of the read, and the "increment" indicates this operaion is performing the second function of the "LSB Logic 31",—i.e. to advance the Read address by one. The carry CY is shown as a logic level that is always high during this time. Although the case of nΔP even is shown, the common case carry for nΔP odd is also high. Because the carry is high, it is an addition that includes an extra least significant bit, and produces an addition of one.

The next operation is to add one half nΔP and to include the carry if and only if we have an odd nΔP. For either case a group of waveforms are shown that are common to both expansion and compression. If the nΔP is odd that means nΔP1 (the least significant bit of nΔP) is asserted true, then the carry is included. Thus a waveform occurs showing nΔP odd (i.e. high) at the same time that the RNCT is plus with carry (+CY). That happens if nΔP is odd. If nΔP is even, then that signal is low, so that just one half nΔP is added without the carry.

The next operation is again to add one half nΔP and at this time all additions are completed. Since this is for the case of compression, the read pointer has been caused to move up to the highest level that it ever has to reach and then an alert check determines whether the two W and R pointers are colliding or not.

This sequence is summarized in FIG. 3B, for the case of compression, where the diagram shows the write pointer W as a 45° diagonal line. The diagram of FIG. 3B shows time as the horizontal axis and memory address as the vertical axis. So the write pointer W runs continuously through memory and the read pointer R1 follows behind it, but because it is running at a lower rate, it has to jump forward in order to keep up with it; that is the case of compression, and the jumping corresponds to deleting segments of audio by jumping over memory. A dotted line labelled ALERT (which is simply a mathematical result of taking the read pointer R1 and adding three halves of the nΔP value to it) is shown by three arrows. This calculation is being done in every cycle. Adding two half nΔP's, will produce one nΔP which is the R2 secondary channel which is called the "look-ahead" pointer. That is the location to which a jump is made should a jump be commanded.

Referring again to the timing diagram FIG. 4, the RRQ line, the read request, signals the data access to do the actual read. When it comes high, it asks data access for permission to act and the acknowledgement of that is called the read access or R Access, RXS, which is generated by the data access module. Referring again to FIG. 3B, after having done two additions on the R count, the R2 data is available. In FIG. 1C there are two strobes called the R1 strobe and the R2 strobe that cause the analog data to be held for the tapered splicing module. They have to follow one another to select R1 data then R2 data. Each strobe takes the output of the digital to analog converter DAC and puts it in the corresponding sample-and-hold circuits 17 and 20.

After three additions it is time to perform the alert operation, and this is shown on the RXS waveform as ALERT. The true level for the Alert operation is shown a little bit wider than the true level for the read cycles. The reason for this is the process block in the flow chart called "wait till write address is surely settled." A large delay, for settling, is exacted and then the R-W is tested. The criteria for this Alert test are shown in FIGS. 3B and 3C. For the case of compression the criterion is when the alert dotted line just crosses the write pointer. When that happens the R-W result is a negative result, and that means that the "time to splice" output is yes, signalling that it is now time to splice. The jump of R1 to the new location and the switching to connect the R1 sample-and-hold to the output, instead of R2, all takes place after the splice has been completed. Actually test jumps are happening all the time. The way an actual jump is made is just by suppressing a return. That is indicated in the timing diagram by dotted pulses for the fourth and fifth counts of the RCNT waveform under the case of compression. These pulses are dotted to indicate that after having completed the splice they are deleted, which causes a net result of having retained for the R1 pointer the value that had been R2. In both the case of compression and the case of expansion there are exactly six counts on the RCNT waveform uless a jump is commanded. For the case of a jump, the jump is done at the end of the splice, and the two dotted pulses are deleted. Thus for that particular cycle there are only four counts.

FIG. 4 also shows the plus-minus level, (+/−), which actually controls the exclusive OR gate 28 in the block diagram FIG. 1B. This level determines whether the next RCNT will produce an add or subtract. In order to cover both the cases of compression and expansion, jumping forward and back is required; thus, both pluses and minuses are needed. The plus-minus waveform is simply a selection of the read sequence generator. In the case of compression it is (2) together with (3) of the read sequence waveform of FIG. 4, so in the middle of the waveform where there is a minus-minus a discontinuity may appear. This is because the read sequence generator is a device that purposely does not overlap the individual signals that are its outputs. In the read sequence waveform there is shown (0), (1), (2), (3). These actually are discrete different outputs out of the device and (2) and (3) together are selected to produce the plus-minus waveform for the case of compression. For the case of expansion the selection is (0) and (1).

The discontinuity in the middle of the high level is simply the consequence of the non-overlapping property and has no logical significance. Note in this diagram that the R1 data, the primary data, is the same in both the case of compression and the case of expansion. It was shown in the flow chart that it is during the R1 data access that is desirable to decide whether it is a case of compression or expansion, and it is essential that the logic does overlap at that R1 data point in order to handle the case of a jittering write clock, at approximately the frequency of the read clock—i.e. when the logic is switching rather rapidly between the cases of compression and expansion.

The difference between compression and expansion then is largely in how the operation alert process is handled. In the RXS waveform it can be seen that Alert occurs after R2 and before R1 for the case of compression. But it is after R1 and before R2 for the case of expansion.

FIG. 3A shows the sequence of operation for the two cases. For the case of compression, the sequence of operation is R1 data access, increment (indicated by R taking R plus 1) then R2 data access, then Alert. FIG. 3A does not show the addition of the one half nΔP's, because FIG. 3A deals only with the order of sequence. Again, for the case compression the sequence is R1, R2 then alert. In the case of expansion the sequence is R1, alert and then R2. The reason for this is that the logic is trying to maintain the same delay characteristics between the write pointer and the average of the read pointer, so that the average delay between the read and the write is the same for both cases. The case of expansion is effectively the same process as the case of compression. It is just done in a different sequence. Common to both cases is the logic of deleting two of the R count pulses, in order to effect the jump at the end of the splice.

The process of maintaining control of the time delay between the write pointer and the read pointer is called "tethering." The rationale behind the logic of employing jumps of the read pointer to a new read location separated from the write pointer by $\frac{1}{2}n\Delta P$ is brought out in FIGS. 5*a* through 5*k*. These figures can be referred to as "a study of tethering policy." This diagram is similar to that shown in FIGS. 3B and 3C where the vertical coordinate represents memory address, and the horizontal coordinate represents time. Because the write function is simply a linear movement through time, the track of the write pointer W is shown as a line at a 45° angle. The track of the read pointer is shown as a slanted line that in the case of compression has a slope less than 45°. In this diagram only the case of compression is shown. The logic for the case of expansion is very much the same except for the fact that the angle of the read pointer track would be greater than 45°.

Figure 5A:
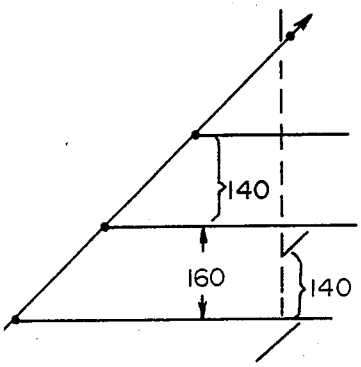
FIGS. 5*a* through 5*h* are a series of diagrams useful in explaining various aspects of tethering the write and read pointers for systems of the type disclosed in the reference co-pending application and for this invention.
Figure 5C:
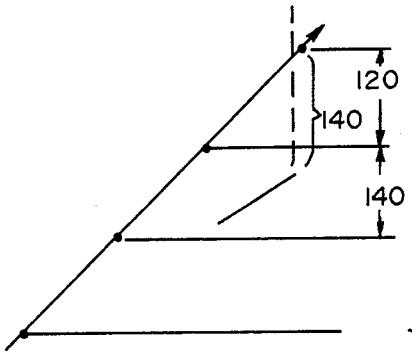
Figure 5F:
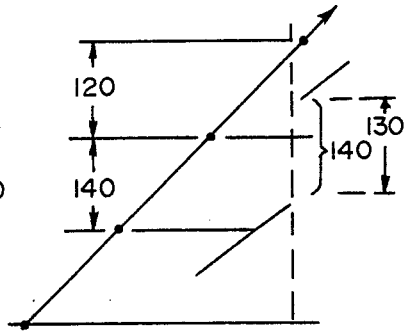
Figure 5B:
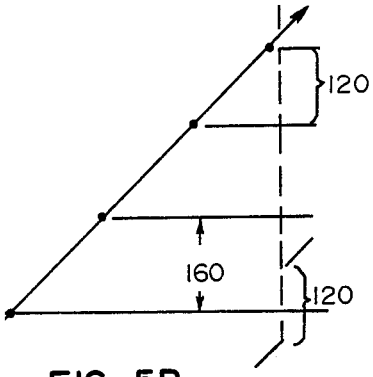
Figure 5D:
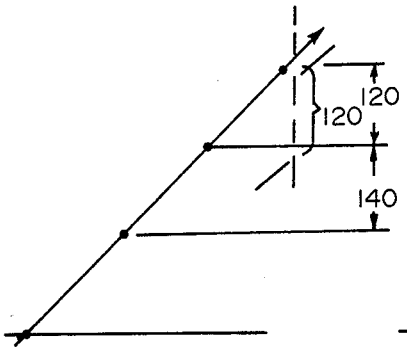
Figure 5G:
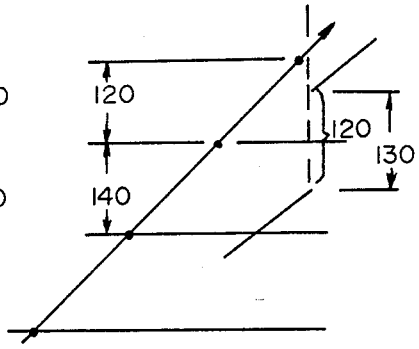
Figure 5E:
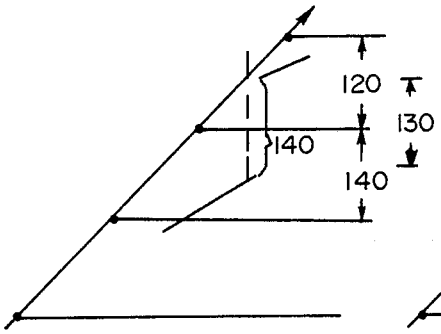
Figure 5H:
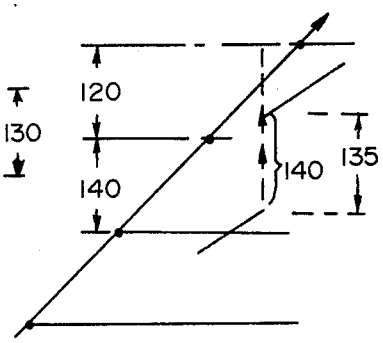
Figure 5I:
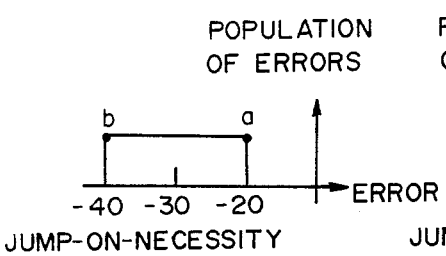
Figure 5J:
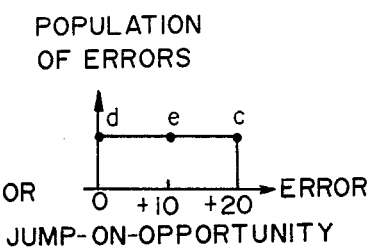
Figure 5K:
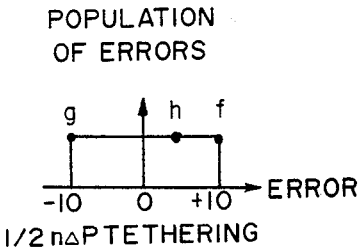

First, let us analyze the kind of tethering policy that was used in the previous patent application; this policy was called "jump-on-necessity." Its operation is shown in the leftmost vertical column consisting of FIGS. 5*a*, 5*b*, and 5*i*. With this policy, in the case of compression where the read pointer runs at a slower rate, a significant delay (separation of the memory locations of the read and write pointers) develops by the time a jump is to be made. This is because a jump is made only "on necessity" when memory is about to be exhausted (i.e. when the write pointer is about to overtake the read pointer). FIGS. 5A and 5B show what develops when the memory size is about 500 addresses and $\Delta P$ is changing from 160 to 140 to 120. Although the principles are the same whatever memory size is used, the error associated with the "jump on necessity" scheme is aggravated by larger memory (assuming F write is the same) and also by the rate of change of $\Delta P$—i.e. for pitch glides, the error is higher than for sound segments with relatively unchanging fundamental frequency.

The dots on the write pointer track show where glottal pulses occur, and the hypothetical pitch periods shown (i.e. as the spacing between the glottal pulses) start with one of 160 write counts, followed by one of 140 counts, then followed by one of 120 counts. In this hypothetical glide, the pitch period is decreasing through time. However, the analysis would be the same if the glide under study was one whose pitch period steadily lengthened through time. The errors (determined as described below) would just be reflected in a different sign. (Note that if the pitch period is not changing the delay does not cause a problem, because the pitch period value is essentially steady-state.)

Since the pitch period detector operates on the audio input signal, its operation in time is roughly synchronous with the writing of signal data into the memory. Thus the count that has been accumulated by the pitch period counter is that for the most recently written pitch period—i.e. it is the count between the last two glottal pulses detected.

In FIG. 5A, a dashed line slightly earlier in time than the uppermost dot is shown. In FIG. 5B, the same dashed line is shown occuring slightly after that last dot. In FIG. 5A when a jump is made at the time of that dashed vertical line, the pitch-period value that is used for the jump is not from the present pitch period (since it has not ended), but rather the previous pitch period—i.e. that of 140 counts—which has been written and measured. Now, when the jump is made using this value of 140, the signal that is being jumped over is in an earlier memory space, and has 160 counts for its period. Thus an error will be introduced. In other words, it would have been much better to have used 160 rather than the count of the pitch period of newer signal information, which is considerably in the future relative to the read pointer. So in the case of FIG. 5A there is an error of 20 counts. This is shown on the bottom of the diagram as point "a", an error of −20, in FIG. 5*i*.

If on the other hand, the jump is made at the time shown by the dashed line in FIG. 5*b*, i.e. just after a new glottal pulse has been recognized and a new pitch-period value (in this case 120 counts) is calculated, then the error is even greater. That is, the jump is made by 120 counts, whereas it should have been by an amount of about 160 for perfect splicing. Thus, in this case, shown as point "b" in FIG. 5*i*, there is an error of −40.

This potential for error of the "jump-on-necessity" scheme was recognized, and actual listening tests in the compression mode detected "clicks" in the audio during glides. Waveform analysis verified that these arose from step discontinuities in the output waveform which are the expected result of errors in pitch jumping during glides. To appreciate this, note that if exactly one actual pitch period of the waveform is removed, not only is the cadence of the pitch periods maintained, but the waveforms to be spliced will be well matched in regard to level and slope (due to the similarity of adjacent pitch periods) and smooth splices will occur automatically. However in the case of compression, as described above, the pitch period information used for the jump may not be appropriate for the waveform segment actually being jumped, due to the delay caused by the separation in memory of the write pointer and the read pointer. The result is mismatching (step discontinuity) of the waveform when spliced.

In the case of expansion, on the other hand, the "jump-on-necessity" scheme should work very well. Since the "time to jump" command occurs when the read pointer is about to overtake the write pointer and since for expansion the jump is made backwards in memory, the problem-causing delay (separation of pointers) of the compression case is eliminated. Listening tests and waveform analysis verified this to be true.

Returning to the problem in compression, and attempt was made to solve it by changing the policy of "jump-on-necessity" to one of "jump-on-opportunity."

In FIGS. 5*c*, 5*d* and 5*e* a study is made of the jump-on-opportunity system, which was actually implemented and did produce some improvement over the first design. But even in this case the error is skewed on one side of the zero error. Cases C and D are analyzed similarly to cases A and B of the jump-on-necessity scheme. (There is also an additional case E.) Cases c and d both feature a glottal pulse nearly coincidental with the time to jump. In case c the jump opportunity presents itself just before the glottal pulse updates the $n\Delta P$, so in this case an earlier value of 140 is used. It would have been better to have used 120. So for this case c there is an error of positive +20. Case d, where a new glottal pulse fortunately updates $n\Delta P$ just before it is needed, results in no error whatsoever, because the count that was accumulated is from the same memory that is being jumped over, a case of zero error. FIG. 5E shows a case in between the two extremes of c and d, where the opportunity to jump occurs half way between glottal pulses. In that case it would probably be best to use the number 130, so there is an error of +10.

The third vertical column FIGS. 5*f*, 5*g* and 5h shows the policy of "one half nΔP" tethering that belongs to this particular embodiment and is described in the block diagram and flow chart. Referring to the error diagrams, FIGS. 5*i* and 5*j* it can be seen that for the same value of glide, the error is negative for the case of jump-on-necessity, but positive for jump-on-opportunity. So it would seem reasonable that there is some policy that will shift the population of errors to surround zero. And that is what is found to be the case for the one half nΔP tethering. Case f and case g again analyze the cases where the glottal pulse happens to be nearly coincident with the time to jump. Now the criterion from the jump for the one half nΔP Policy is that the jump is executed such that the read pointer after jumping starts from a point one half nΔP away from the write pointer. FIGS. 5*f* and 5*g* are scaled so that for each magnitude of jump there is half of its magnitude left over (between the read and the write pointers) at the end of the jump. For case F the jump was by an amount 140 when it probably would have been more appropriate to jump by 130, so that gives an error of positive 10, which is designated f on the error diagram, FIG. 5*k*. In case g the glottal pulse happened just prior to a jump but that did not lead to a zero error (as in the case of the "jump on opportunity" scheme) because the jump is not over that same memory, but over a memory space slightly behind it. That is, value of 120, that was the freshest value, was used when the jump is over older memory. Thus it should have been about 130 to produce a perfect jump and in this case the error is negative 10; it appears in FIG. 5*k* as point g.

Because there is no interpolater in this embodiment, it is not possible to get an error of exactly zero but it can be shown that all other cases produce an error that is in between the case of −10 and +10, and that is what is of real concern. The objective is to minimize the largest magnitude of errors, the worst case, rather than try to produce an exact jump on occasion, as was done for jump-on-opportunity, because that exact case will not happen very often—i.e. only when the glottal pulse and the jump are nearly coincident. So in the ½nΔP scheme, the case of having an exact match is sacrificed in order to have the worst case error reduced from being the +20 of the jump-on-opportunity scheme to either +10 or −10. Case H shows what happens for a jump in between a glottal pulse update. The jump is over a portion of memory that probably should be something on the order of 135 but 140 is used. The reason that this method is called one-half nΔP is because it is the one-half NΔP "building block" that is exploited twice to produce a jump and exploited three times for an Alert test. After a jump there is still a remainder of one half nΔP representing the new (instantaneous) separation of the read and write pointers; thus the least delay possible in this method is one half nΔP. BUt the delay actually varies between one half nΔP and three halves NΔP. The average delay is one nΔP.

Referring to FIGS. 3B and 3C, the operation of adding three halves nΔP to form an Alert pointer is represented by the three arrows pointed up from the pointer that is deepest in memory, R1 for the case of compression, R2 for the case of expansion. It should be kept in mind that until the time to splice, each positive jump is reneged by an equivalent negative jump. These negative jumps are not shown in FIGS. 3B and 3C.

Referring to the jump timing diagram, FIG. 4, the detailed timing operation is shown. Each "+" represents an addition of one half nΔP, each "−" represents a subtraction of one half nΔP. For each cycle there are six of these operations, three additions nearly balanced by three subtractions. The second function of the "LSB Logic" is to make "nearly" an advance of exactly one address for each cycle.

We claim:

1. Apparatus for pitch conversion of an audio signal comprising:

means for deriving sequential samples of said audio signal and converting said samples into digital signals;

a memory for storing said digital signals;

means for sequentially writing said digital signals into said memory at a first fixed writing rate;

means for reading out, in the same sequential order, said digital signals stored in said memory at a second rate different from said first rate, said second rate being selected to produce a desired pitch conversion; and means for modifying the reading at said second rate such that the average reading rate approximates said first fixed writing rate comprising;

means for monitoring the address differential in said memory at which said writing and reading is taking place, means for determining the pitch period P of said audio signal, and means for jumping the reading address as said differential becomes larger than a predetermined function of pitch period, said jump being in a direction to reduce said differential.

2. Apparatus according to claim 1 for the case where said reading rate is less than said writing rate wherein an address value representing the value 3/2nΔP is added to the current read address to form a sum address, where ΔP is the rate of change of said pitch period and n is a selected number of said pitch periods, and said modifying means further includes means for comparing the sum address with the current write address and said jumping means jumps said current read address by nΔP when the comparison changes sign.

3. Apparatus according to claim 1 for the case where said reading rate is greater than said writing rate wherein an address value representing ½nΔP is added to the current read address to form a sum address, where ΔP is the rate of change of said pitch period and n is a selected number of said pitch periods, and said modifying means further includes means for comparing the sum address with the current write address and said jumping means jumps said current read address by nΔP when the comparison changes sign.

4. A tapered splice apparatus for combining digital data signals representing an audio signal wherein said digital data signals are read out of memory in an ordered sequence and the read addresses thereof are changed in steps to new memory addresses comprising:

a first addressable data pointer for reading digital data signals from sequential addresses in said memory;

means for determining the pitch period of said audio signal;

a second addressable data pointer for reading data signals from said memory at addresses separated by a predetermined amount which is approximately an integral number of said pitch periods from the addresses of said first data pointer;

means responsive to a apredetermined condition for changing the address of said first data pointer to the address then occuied by said second data pointer; and means for combining the data values of the digital data signals read by said first and second data pointers during said changing to provide a transition signal value that changes gradually in said steps from the data value of the digital data signal read by said first data pointer to the data value of the digital data signal read by said second data pointer.

5. Apparatus according to claim 4 wherein said digital data signals are written into said memory sequentially at the rate different than the rate at which said first data pointer reads said digital data signals out of said memory and said predetermined condition is the convergence of the writing address and the reading address of said first data pointer to within a predetermined limit.

6. Apparatus according to claim 5 wherein said predetermined limit is approximately $\frac{1}{2}n\Delta P$ wherein said audio signal has a pitch period P, $\Delta P$ is the rate of change of said pitch period, and n is a selected number of said pitch periods.

7. Apparatus according to claim 4 wherein said digital data signals are written into said memory sequentially at a rate different than the rate at which said first data pointer reads said digital data signals out of said memory and said predetermined condition is the divergence of the writing address and the reading address of said first data pointer by more than a predetermined limit.

8. Apparatus according to claim 7 wherein said predetermined limit is approximately $3/2n\Delta P$ wherein said audio signal has a pitch period P, $\Delta P$ is the rate of change of said pitch period, and n is a selected number of said pitch periods.

* * * * *